United States Patent [19]

Horlbeck et al.

[11] 4,447,573

[45] May 8, 1984

[54] TEXTILE HOT-MELT ADHESIVE

[75] Inventors: Gernot Horlbeck, Haltern; Rainer Feldmann, Marl, both of Fed. Rep. of Germany

[73] Assignee: Chemische Werke Huels AG, Marl, Fed. Rep. of Germany

[21] Appl. No.: 421,630

[22] Filed: Sep. 22, 1982

[30] Foreign Application Priority Data

Sep. 25, 1981 [DE] Fed. Rep. of Germany ..... 3138187

[51] Int. Cl.[3] ..... C09J 3/16; C09J 5/06

[52] U.S. Cl. ..... 524/394; 156/332; 260/DIG. 35; 427/208.2; 427/389.9; 524/400; 524/423; 524/425; 524/430; 524/449; 524/451; 524/605

[58] Field of Search ..... 524/394, 400, 903, 605; 427/208.2, 389.9; 156/332; 260/DIG. 35

[56] References Cited

U.S. PATENT DOCUMENTS

| | | | |
|---|---|---|---|
| 3,669,921 | 6/1972 | Droke et al. | 524/394 |
| 3,893,976 | 7/1975 | Modler et al. | 156/332 |
| 3,926,920 | 12/1975 | Georgoudis et al. | 156/332 |
| 4,094,721 | 6/1978 | Sturm et al. | 156/306.6 |
| 4,217,426 | 8/1980 | McConnell et al. | 525/173 |
| 4,252,940 | 2/1981 | Sublett | 156/332 |
| 4,368,286 | 1/1983 | Hayashi et al. | 524/605 |

*Primary Examiner*—Ronald W. Griffin

*Attorney, Agent, or Firm*—Millen & White

[57] ABSTRACT

A textile hot-melt adhesive comprises a mixture of

A. a linear, saturated, high-molecular weight copolyester (75–95 mole % of terephthalic acid, 5–25 mole % of (iso-)phthalic acid; 40–70 mole % of butanediol and 30–60 mole % of other aliphatic diols;

B. 0.05–0.5% by weight of an inorganic powder (particle diameter: 0.5–3 μm);

C. 0.01–0.2% by weight of an alkaline earth metal salt of a fatty acid (particle diameter: 40–60 μm; and D. optionally, customary auxiliary agents and additives.

12 Claims, No Drawings

TEXTILE HOT-MELT ADHESIVE

BACKGROUND OF THE INVENTION

Textile, hot-melt (fusion) adhesives based on linear, saturated, high-molecular weight copolyesters are known. However, the heretofore available products exhibit certain disadvantages which restrict their practical applicability in specific working areas.

Thus, DOS No. 1,920,432 describes copolyesters of terephthalic acid, adipic acid, ethylene glycol, and 1,4-butanediol. However, the softening points of these copolyesters (>130° C.) are too high for use as heat-sensitive materials; alternatively, the copolyesters having a low softening point (<130° C.), due to their low crystallinity, exhibit such a tackiness even at room temperature that they are unsuitable for use as pulverulent hot-melt adhesives. Moreover, the dry cleaning stability of these copolyesters leaves much to be desired.

DAS No. 2,435,863 discloses copolyesters of terephthalic acid, isophthalic acid and/or an aliphatic dicarboxylic acid and 1,4-butanediol/1,6-hexanediol mixtures as the diol component. These copolyesters are characterized, inter alia, by melting points of >40° C., which are too low. The degree of crystallization of these copolyesters is indeed slightly higher than in those products mentioned in DOS No. 1,920,432. However, the crystallizing velocity of the resultant granulated material obtained under practical conditions is so low that technical disturbances occur due to agglomeration during grinding of the granules and classification of the powder (U.S. Pat. No. 4,217,426); also, the shelf stability of such powders is low due to caking. During processing, the pressure rolls of the powder point machines frequently become gummed up.

To avoid the aforementioned drawbacks, U.S. Pat. No. 4,217,426 proposes blending copolyesters with low-viscosity polyethylene waxes. The blending represents an additional process step. Moreover, the compatibility of the polyethylene waxes with the copolyesters is so minor that even at low concentrations of the polyethylene wax, a brittle, frangible material is obtained.

SUMMARY OF THE INVENTION

Accordingly, it is an object of the present invention to provide a product which avoids or ameliorates the above-described disadvantages.

Upon further study of the specification and appended claims, further objects and advantages of this invention will become apparent to those skilled in the art.

These objects have been attained by providing a textile hot-melt adhesive comprising a mixture of A. a linear, saturated, high-molecular weight copolyester containing
   I. in its dicarboxylic acid component,
      75–95 mole % of terephthalic acid
      5–25 mole % of isophthalic acid and/or phthalic acid,
   II. in its diol component,
      40–70 mole % of 1,4-butanediol
      30–60 mole % of other aliphatic diols of 5–12 carbon atoms,
   wherein the copolyester has a melting point in the range of 110° to 130° and a crystallization half-life value, measured at 50° C., of <7 minutes;

B. 0.05–0.5% by weight of an inorganic powder having an average particle diameter of 0.2–3 μm;

C. 0.01–0.2% by weight of an alkaline earth metal salt of a fatty acid of 11–18 carbon atoms and an average particle diameter of 40–60 μm; and D. optionally, conventional auxiliary agents and additives, all data being in weight percent based on the amount of component A.

DETAILED DISCUSSION

The dicarboxylic acid component preferably comprises 80–90 mole % of terephthalic acid units.

Examples of other suitable aliphatic diols include 1,5-pentanediol, 1,8-octanediol, 1,10-decanediol, or 1,12-dodecanediol. 1,6-Hexanediol is preferably employed. These diols preferably represent 35–55 mole % of the other diol component.

Other aliphatic diols which can be used include also oxa- or dioxaalkanediols, such as, for example, diethylene glycol (3-oxa-1,5-pentanediol), dibutylene glycol (5-oxa-1,9-nonanediol), 3-oxa-1,7-heptanediol, or 3,8-dioxa-1,10-decanediol. In this group of diols, dibutylene glycol is preferred. These diols preferably represent 50–60 mol-% of the other diol component.

The copolyesters usually contain 100 mole % of the dicarboxylic acid component and 100 mole % of the diol component.

The copolyesters can be produced analogously to conventional poly(butyleneterephthalate) manufacture as described, for example, in Sorensen and Campbell, Preparative Methods of Polymer Chemistry, Interscience NY 1961: 111–127; and in "Kunststoffhandbuch" [Plastics Manual] Vol. 8 (Polyesters), C. Hanser Publishers, Munich 1973: 697; or in Journal of Polymer Science, Part Al, 4: 1851–1859 (1966), all of whose disclosures are incorporated by reference herein. The copolyesters can also be produced by conventional continuous processes.

If free acids are used in the preparation, the esterification can take place before the transesterification of any dialkyl esters that may be utilized, as well as during or after the transesterification.

It is possible to add to the copolyesters, as early as during the course of the manufacturing process, fully conventional amounts of processing aids, thermostabilizers, UV stabilizers, optical brighteners, etc.

The copolyesters have viscosity numbers (J) of 60–75 $cm^3/g$, preferably 63–72 $cm^3/g$. The glass transition range ($T_g$) is 5°–30° C., preferably 10°–25° C. Furthermore, the copolyesters have a crystallization half-life value ($t_{1/2}$) (at 50° C.) of <7 minutes, preferably <6 minutes. The melting point ($T_m$) of the copolyesters is in the range of 110° to 130° C. All of these parameters are measured fully conventionally.

Suitable inorganic powders include, for example, nucleating agents such as titanium dioxide, talc, aluminum oxide, silicic acid, mica, barium sulfate, calcium carbonate, or calcium sulfate, or the like; preferred are talc and titanium dioxide. The addition takes place preferably during the production of the copolyester. The inorganic powder is preferably used in amounts of 0.1 to 0.3% by weight, based on the amount of copolyester (component A).

Examples of suitable alkaline earth metal salts of fatty acids include stearates, oleates, palmitates, or laurates of magnesium, calcium, or barium. Magnesium or calcium stearate are preferred. The salts are preferably added in amounts of 0.05–0.15% by weight, based on the amount of copolyester (component A). The addition of these salts while the copolyester is still in granular or pellet form is technically advantageous. In specific cases, the salts can also be added after the powdery textile hot-melt adhesive has been produced. Except as indicated otherwise herein, the production of the hot-melt adhesives is conventional as disclosed, e.g., in U.S. Pat. No. 4,094,721.

Conventional additives such as UV stabilizers, thermostabilizers, optical brighteners, etc., can furthermore be added as auxiliary agents and additives in the usual amounts, such as 0,1–2,5 wt. % based on the amount of copolyester (component A).

The processing of the copolyesters into pulverulent products can be effected according to conventional methods, for example by the cold grinding method.

The particle size distribution of the textile hot-melt adhesives of this invention is to be, in the spotwise paste fusing process, <80 μm; in the spotwise powder fusion method, 60–200 μm; and in the spreading powder fusion method, 200–500 μm—these methods are described in H. Rose, Fusible Inclinings—Highgate Publications, London (1979).

The characteristic data herein are determined as follows:

The viscosity number (J) is measured with solutions of 0.23 g of copolyester in 100 ml of a mixture of phenol/1,1,2,2-tetrachloroethane (weight ratio 60/40) at 25° C.

The melting point ($T_m$) is conventionally represented by the melt maximum determined in differential scanning calorimetry (DSC; cooling and/or heating-up rate: 16° C./minute).

The glass transition range ($T_g$) is the conventional temperature interval in the DSC curve resulting from the difference of the points of intersection of the tangent drawn at the turning point—caused by the change in specific heat—with each of the extrapolated straight lines above and below this range. For measuring purposes, the sample, melted to 30° C. above the melting point, is cooled at a rate of 16° C./minute.

The crystallization half-life value ($t_{1/2}$) is determined using a differential calorimeter. For this purpose, the sample to be tested is melted and cooled off, at 15° C./minute, to the crystallizing temperature of 50° C. (isothermal crystallization). Determination of the time necessary at this temperature to reach half the value of the crystallization heat, yields the half-life value ($t_{1/2}$).

To test adhesive strength (bonding strength), degree of adhesion, and dry cleaning and laundering stability, powders having a particle size distribution of 60–200 μm are applied to a commercially available lining fabric by means of a spotwise powder applicator machine with a 17 mesh grid with a contact pressure of 20±2 g/m². In an ironing press, the fabric is bonded to a commercially available top fabric at 130° C. under an ironing pressure of 350 g/cm². The bonded parts are washed three times at 60° C. with a commercial laundry detergent and dry cleaned three times with a customary chemical dry cleaning agent. The separating strength is determined according to DIN 54 310, the values being indicated in N/5 cm.

The hot-melt adhesives of this invention are used for the same purposes and in the same way as prior art hot-melt adhesives.

Without further elaboration, it is believed that one skilled in the art can, using the preceding description, utilize the present invention to its fullest extent. The following preferred specific embodiments are, therefore, to be construed as merely illustrative, and not limitative of the remainder of the disclosure in any way whatsoever. In the following examples, all temperatures are set forth uncorrected in degrees Celsius; unless otherwise indicated, all parts and percentages are by weight.

EXAMPLES

A. Production of a Hot-Melt Adhesive

EXAMPLES 1–8

A melt is prepared in a 100-liter vessel from 33.0 kg of dimethyl terephthalate, 5.0 kg of isophthalic acid, 13.5 kg of 1,4-butanediol, 15.6 kg of 1,5-pentanediol, and 12 g of titanium tetraisopropylate at 150° C. and, after the addition of 88 g of talc, is interesterified and esterified, respectively, at 190° C. under a nitrogen stream and with agitation until the theoretical quantity of methanol and $H_2O$ has been split off. Thereafter, the reaction temperature is raised within one hour to 250° C. and a vacuum of ≦1 mbar is applied within another hour. Under these conditions, the melt is polycondensed for 2 hours. The vacuum is lifted with nitrogen; then the product is discharged, cooled, and granulated. The fatty acid salt shown in Table 1 is added to the finished granules in a drum.

TABLE 1

Composition of Hot-Melt Adhesives (Examples 1–8)

| | Polyester Composition | | | | Inorganic | Fatty Acid Salt | |
|---|---|---|---|---|---|---|---|
| Example | TA* mol-% | IA* mol-% | BD* mol-% | Aliphatic Diol mol-% | Powder** % by Wt.*** | % by Weight*** | Average Particle Diameter [μm] |
| 1 | 85 | 15 | 47 | 1,5-Pentanediol 53 | Talc 0.2 | Ca Stearate 0.05 | 50 |
| 2 | 80 | 20 | 48 | 1,6-Hexanediol 52 | $TiO_2$ 0.15 | Mg Stearate 0.05 | 50 |
| 3 | 80 | 20 | 60 | 1,10-Decanediol 40 | $TiO_2$ 0.1 | Ca Palmitate 0.07 | 50 |
| 4 | 85 | 15 | 60 | 1,12-Dodecanediol 40 | Talc 0.1 | Mg Laurate 0.03 | 45 |
| 5 | 75 | 25 | 62 | Diethylene Glycol 38 | Talc 0.02 | Ca Stearate 0.05 | 40 |
| 6 | 87 | 13 | 50 | Dibutylene Glycol 50 | $TiO_2$ 0.2 | Ba Stearate 0.05 | 60 |
| 7 | 85 | 15 | 55 | 1,6-Hexanediol 45 | $TiO_2$ 0.2 | Ca Stearate 0.06 | 50 |
| 8 | 75 | 25 | 45 | 1,6-Hexanediol | Talc | Ca Stearate | 50 |

TABLE 1-continued

| Composition of Hot-Melt Adhesives (Examples 1–8) | | | | | | | |
|---|---|---|---|---|---|---|---|
| | Polyester Composition | | | | Inorganic | Fatty Acid Salt | |
| Example | TA* mol-% | IA* mol-% | BD* mol-% | Aliphatic Diol mol-% | Powder** % by Wt.*** | % by Weight*** | Average Particle Diameter [μm] |
| | | | | 55 | 0.15 | 0.06 | |

*TA = Terephthalic acid; IA = Isophthalic acid; PA = Phthalic acid; BD = 1,4-Butanediol
**Talc: "MIKROTALK" II Extra (Norwegian Tale Deutschland GmbH), Average particle size: 0.75 μm
$TiO_2$: "BAYERTITAN" RFD I (Bayer AG), Average particle size: 0.25 μm
***Weight percent, based on copolyester (component A)

TABLE 2

| Characteristic Data of Hot-Melt Adhesives | | | | |
|---|---|---|---|---|
| Example | J [$cm^3/g$] | $T_m$ [°C.] | $T_g$ [°C.] | $t_{\frac{1}{2}}$ (50° C.) [min] |
| 1 | 65 | 120 | 14–20 | 4.8 |
| 2 | 68 | 116 | 13–20 | 5.0 |
| 3 | 68 | 118 | 10–15 | 4.8 |
| 4 | 64 | 119 | 8–14 | 4.7 |
| 5 | 69 | 123 | 16–21 | 5.3 |
| 6 | 71 | 119 | 16–22 | 5.4 |
| 7 | 66 | 118 | 13–19 | 5.0 |
| 8 | 67 | 111 | 10–16 | 5.6 |

EXAMPLE 9

A melt is prepared in a 100-liter vessel from 33.0 kg of dimethyl terephthalate, 4.45 kg of phthalic anhydride, 13.5 kg of 1,4-butanediol, 17.7 kg of 1,6-hexanediol, and 13 g of titanium tetraisopropylate at 150° C.; 88 g of titanium dioxide is added thereto, and the reaction mixture is interesterified and esterified, respectively, at 200° C. in a nitrogen stream under agitation until the theoretical quantity of methanol and $H_2O$ has been split off. Thereafter the reaction temperature is raised within 1.5 hours to 250° C., and a water-jet aspirator is employed; within another hour, the vacuum is brought to $\leqq 1$ mbar. Under these conditions, the melt is polycondensed for 2 hours. The vacuum is eliminated with nitrogen, and then the copolyester is discharged, cooled, and granulated. The fatty acid salt is applied to the finished granules in a drum.

TABLE 4

| Characteristic Data of Hot-Melt Adhesives | | | | |
|---|---|---|---|---|
| Example | J [$cm^3/g$] | $T_m$ [°C.] | $T_g$ [°C.] | $t_{\frac{1}{2}}$ (50° C.) [min] |
| 9 | 68 | 113 | 10–17 | 6.3 |
| 10 | 65 | 110 | 11–16 | 6.5 |
| 11 | 65 | 117 | 12–18 | 5.4 |
| 12 | 70 | 125 | 12–20 | 4.8 |
| 13 | 64 | 120 | 9–15 | 5.1 |
| A | 82 | 135 | — | — |
| B | 82 | 125 | — | — |
| C | 80 | 90 | 19 | — |

B. Properties of Hot-Melt Adhesives in Practical Application

The results compiled in Table 5 were obtained in testing the classifiability of the granulated material, the processability of the powder, and the splitting strength of the fabric bond.

The comparative examples demonstrate that hot-melt adhesives produced according to DOS No. 1,920,432 (Examples 4 and 3, respectively), having melting ranges of above 130° C., are no longer fixable with satisfactory results. At lower melting points (<130° C.), the granules cake together so obstinately that they can no longer be classified (Examples A and B). Granules produced according to DAS No. 2,435,863 (Table 3) can still be ground and classified, but the powders cake already at room temperature and gum up the engravings on the roll of the powder spotting machine (Example C). Furthermore, the resultant splitting strength values are low.

TABLE 3

| Composition of Hot-Melt Adhesives (Examples 9–13 and A–C) | | | | | | | |
|---|---|---|---|---|---|---|---|
| | Polyester Composition | | | | Inorganic | Fatty Acid Salt | |
| Example | TA* mol-% | PA* mol-% | BD* mol-% | Aliphatic Diol mol-% | Powder* % by Wt.* | % by Wt.* | Average Particle Diameter [μm] |
| 9 | 85 | 15 | 48 | 1,6-Hexanediol 52 | $TiO_2$ 0.2 | Ca Stearate 0.05 | 50 |
| 10 | 80 | 20 | 50 | 1,6-Hexanediol 50 | Talc 0.1 | Ca Stearate 0.07 | 50 |
| 11 | 88 | 12 | 55 | 1,6-Hexanediol 45 | $TiO_2$ 0.15 | Mg Stearate 0.05 | 50 |
| 12 | 88 | 12 | 60 | 1,10-Decanediol 40 | $TiO_2$ 0.15 | Mg Stearate 0.07 | 50 |
| 13 | 78 | 22 | 65 | 1,12-Dodecanediol 35 | $TiO_2$ 0.15 | Ca Stearate 0.08 | 40 |
| A | 60 | 40** | 50 | Ethylene Glycol 50 | $TiO_2$ <2 | — | — |
| B | 75 | 25** | 25 | Ethylene Glycol 75 | — | — | — |
| C | 70 | 30*** | 50 | 1,6-Hexanediol 50 | — | — | — |

*Explanations, see notes at Table 1
**Adipic Acid
***Isophthalic Acid

TABLE 5

| Ex-ample | Classifiable | Processability of Powder | Properties in Practical Application: Splitting Strength [N/5 cm] Untreated | After Laundering | After Dry Cleaning |
|---|---|---|---|---|---|
| A | Yes | Adequate | 5.0 | n.a.* | n.a.* |
| B | No (Lumps) | Poor | 7.0 | 6.0 | 3.0 |
| C | Yes | Poor, Gums Up Engraving | 6.5 | 6.0 | 4.0 |
| 1 | Yes | Good | 12.5 | 12.0 | 11.0 |
| 2 | Yes | Good | 14.0 | 12.5 | 12.0 |
| 3 | Yes | Good | 13.0 | 12.0 | 10.5 |
| 4 | Yes | Good | 12.5 | 11.0 | 8.5 |
| 5 | Yes | Good | 11.0 | 12.0 | 9.0 |
| 6 | Yes | Good | 10.0 | 9.0 | 8.0 |
| 7 | Yes | Good | 13.5 | 13.5 | 12.0 |
| 8 | Yes | Good | 10.0 | 12.5 | 9.0 |
| 9 | Yes | Good | 15.0 | 12.0 | 12.0 |
| 10 | Yes | Good | 15.0 | 11.5 | 10.0 |
| 11 | Yes | Good | 11.5 | 11.0 | 10.0 |
| 12 | Yes | Good | 10.5 | 10.5 | 10.0 |
| 13 | Yes | Good | 11.5 | 10.5 | 10.5 |

*n.a. = No Adhesion

The preceding examples can be repeated with similar success by substituting the generically or specifically described reactants and/or operating conditions of this invention for those used in the preceding examples. From the foregoing description, one skilled in the art can easily ascertain the essential characteristics of this invention, and without departing from the spirit and scope thereof, can make various changes and modifications of the invention to adapt it to various usages and conditions.

What is claimed is:

1. A textile hot-melt adhesive, comprising a mixture of

A. a linear, saturated, high-molecular weight copolyester reaction product of

I. 100 mole % of a dicarboxylic acid component of 75–95 mole % of terephthalic acid 5–25 mole % of isophthalic acid or phthalic acid, II. 100 mole % of a diol component of 40–70 mole % of 1,4-butanediol 30–60 mole % of another diol of 5–12 carbon atoms which is an alkane diol or an oxa- or dioxa-alkane diol, wherein the copolyester has a melting point of 110° to 130° C. and a crystallization half-life value, measured at 50° C., of <7 minutes;

B. 0.05–0.5% by weight of an inert inorganic nucleating agent having an average particle diameter of 0.2–3 μm; and C. 0.01–0.2% by weight of an alkaline earth metal salt of a fatty acid of 11–18 carbon atoms and an average particle diameter of 40–60 μm; wherein all weight percentage ranges are based on the amount of component A.

2. A textile hot-melt adhesive of claim 1 further comprising an additive useful in textile hot-melt adhesives.

3. A textile hot-melt adhesive of claim 1 wherein component A.I. is 80–90% mole % of terephthalic acid units.

4. A textile hot-melt adhesive of claim 1 or 3 wherein component A.II. comprises 35–55 mole % of an alkane diol.

5. A textile hot-melt adhesive of claim 4 wherein the alkane diol is 1,5-pentanediol,1,8-octanediol,1,10-decanediol,1,12-dodecanediol or 1,6-hexanediol.

6. A textile hot-melt adhesive of claim 1 or 3 wherein component A.II. comprises 50–60 mole % of an oxa- or dioxa-alkane diol.

7. A textile hot-melt adhesive of claim 6 wherein the diol is diethyleneglycol, dibutyleneglycol, 3-oxa-1,7-heptanediol or 3,8-dioxa-1,10-deconediol.

8. A textile hot-melt adhesive of claim 1 wherein the copolyester has a viscosity number (J) of 60–75 $cm^3/g$, a Tg of 5°–30° C., a crystallization half-life of <7 min. (at 50° C.), and a melting point of 110°–130° C.

9. A textile hot-melt adhesive of claim 1 wherein the inorganic powder is titanium dioxide, talc, aluminum oxide, silicic acid, mica, barium sulfate, calcium carbonate, or calcium sulfate.

10. A textile hot-melt adhesive of claim 1 wherein the alkaline earth metal salt of a fatty acid is a stearate, oleate, palmitate or laurate of Mg, Ca or Ba.

11. A textile hot-melt adhesive of claim 2 wherein the additive is a UV stabilizer, a thermostabilizer or an optical brightener.

12. In a method of bonding to a textile comprising applying a hot-melt adhesive to the textile and heating, the improvement wherein the hot-melt adhesive is that of claim 1.

* * * * *